US006311922B1

(12) United States Patent
Beisswanger et al.

(10) Patent No.: US 6,311,922 B1
(45) Date of Patent: Nov. 6, 2001

(54) METHOD AND APPARATUS FOR WINDING A MATERIAL WEB

(75) Inventors: Rudolf Beisswanger, Steinheim; Zygmunt Madrzak, Heidenheim; Roland Möller, Herbrechtingen; Georg Ihle, Steinheim; Karl Josef Böck, Heidenheim, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/309,561

(22) Filed: May 12, 1999

(30) Foreign Application Priority Data

May 18, 1998 (DE) ..... 198 22 261
Nov. 12, 1998 (DE) ..... 198 52 257

(51) Int. Cl.[7] ..... B65H 18/14
(52) U.S. Cl. ..... 242/542.3; 242/541.4
(58) Field of Search ..... 242/541.1, 541.5, 242/541.6, 541.7, 542.3, 541.4

(56) References Cited

U.S. PATENT DOCUMENTS 2,613,039 10/1952 Holcomb .
3,834,642 9/1974 Kampf .
5,251,835 10/1993 Kyytsönen .
5,308,008 5/1994 Rüegg .

FOREIGN PATENT DOCUMENTS 282 7/1877 (DE) .
2447780 10/1974 (DE) .
4008897 9/1991 (DE) .
19607349 8/1997 (DE) .
19635216 3/1998 (DE) .
29721832 5/1998 (DE) .
0483092 4/1992 (EP) .
483092 4/1992 (EP) .
1411333 12/1965 (FR) .
1600070 10/1981 (GB) .
94/26641 11/1994 (WO) .
95/13965 5/1995 (WO) .
95/30049 11/1995 (WO) .

OTHER PUBLICATIONS

English Language Abstract of JP 8002757 (published by Japanese Patent Office, including an illustration).

English Language Abstract of JP 8002757 (Dialog abstract).

An English Language abstract of JP 8–002757.

Prospekt: Tragtrommelroller der Fa. Voith GmbH, Hedenheim, Nr. 1.67 3000.

JP 04182249, Jun. 29, 1992, Abstract.

*Primary Examiner*—John Q. Nguyen
(74) *Attorney, Agent, or Firm*—Greenblum & Bernstein, P.L.C.

(57) ABSTRACT

A winding machine and process for winding a material web onto a reel. The material web is guided around a carrying drum, in which a nip is formed between the carrying drum and the reel. One of the reel and the carrying drum may be cyclically inclined in relation to a travel direction of the material web by a drive device or press device in order to achieve an axial changing of the material web in a winding roll.

16 Claims, 6 Drawing Sheets

METHOD AND APPARATUS FOR WINDING A MATERIAL WEB

CROSS-REFERENCE TO RELATED APPLICATIONS

The present application claims priority under 35 U.S.C. §119 of German Patent Application No. 198 22 261.0 filed on May 18, 1998, and German Patent Application No. 198 52 257.6 filed on Nov. 12, 1998, the disclosures of which are expressly incorporated by reference herein in their entirety.

BACKGROUND OF THE INVENTION

1. Field of the Invention

The invention is directed to a method and apparatus for winding a material web.

2. Discussion of Background Information

The present invention relates to an apparatus and method for winding a material web, such as, but not limited to, a paper or cardboard web, onto a reel, in which the material web is guided around a carrying drum, and in which a nip is formed between the carrying drum and the reel. The carrying drum and a winding roll that is being produced (e.g., the reel with the material web wound thereon) are kept in contact with each other during the winding process.

A winding machine and a process for winding a material web is disclosed, for example, in EP 0 483 092 A1. Such winding machines are used, for example, at the end of an operation for producing (or refining) a material web, such as, for example, a paper web. However, such machines can also be used, for example, to rewind a winding roll that has already been completely wound.

During a winding operation, irregularities can occur in cross direction profiles. In particular, irregularities can occur in the thickness profile of a material web. With regard to a paper machine, these irregularities usually occur only temporarily, because such irregularities can be eliminated by, for example, adjusting the head box. Nevertheless, such prior art devices have a disadvantageous influence on the winding formation. For example, a situation can arise in which a winding diameter is greater than a desired diameter at one point of the web width. When his occurs, there is no longer a cylindrical winding formation. An undesirable over-stretching of the material web may then occur, which can, for example, have an adverse effect on the flatness of, for example, graphic paper.

PCT patent document WO 95/30049 and German patent document DE 297 21 832, respectively, disclose a process for producing a fibrous material web, such as, for example, a paper or cardboard web, out of a fibrous suspension, in which the material web, after completely drying, is calendered online and subsequently wound onto a winding roll, However, defects in calender stack rolls, due to, for example, wear or the like, and/or variations in a moisture cross direction profile lead to local thickness variations in the calendering. If the varying thicknesses always occur at the same point in the winding of the web, web stretching and a poor travel of the material web in the reel cutting machine results.

SUMMARY OF THE INVENTION

Accordingly, an object of the current invention is to create a method and a winding machine for winding a material web that does not exhibit the problems discussed above. Specifically, the current invention discloses a winding machine (and a method for winding a material web) that reliably produces "perfect" windings, even in the presence of irregularities in the material web.

The object of the current invention is attained by cyclically inclining a reel and/or carrying drum of the winding machine in relation to a travel direction of a supplied material web. This arrangement results in a cyclical side traverse motion of the web in the winding roll that is produced.

The reel or carrying drum is alternatively shifted (or pivoted) in a first direction and then in a second direction. The carrying drum and the winding roll (that is being produced) on the reel are kept in contact with each other during the winding operation. That is, a nip of the winding machine is maintained as the material web is wound onto the winding roll. As a result of the cyclical inclination and the side traverse motion of the web, potentially occurring irregularities in the material web, such as, for example, an irregularly changing thickness cross direction profile, are distributed over a greater range over the web width, so that an impairment of the desired winding formation is prevented (or minimized). Despite possible irregularities, a virtually cylindrical winding diameter of the winding roll can be achieved.

Through the controlled cyclical inclination of the reel or carrying drum, the material web is displaced by a desired amount, and thus, cyclically traversed on the reel.

In a preferred embodiment of the invention, the reel is cyclically inclined and the movable drum is guided in a tracking motion in order to maintain the nip. In this connection, the movable carrying drum can also be used to adjust a line force in the nip. The line force is preferably kept constant at a predetermined value. The reel is suitably moved along at least one guide track, wherein it is simultaneously cyclically inclined in the process.

To ensure that the carrying drum always tracks the reel, and the line force in the nip is kept constant, the inclined position of the reel is not normally permitted to be greater than a stroke of the carrying drum.

In a practical embodiment of the invention, the reel, together with the winding roll being produced, is transported along a first guide track from a winding-start position to a transfer position, and along a second guide track from the transfer position to a finished winding position. After a new, still empty reel is brought into the winding-start position, the nip is formed (by virtue of the fact that the reel and the carrying drum are brought into contact with each other). After the material web is cut crosswise to its travel direction, the beginning of the new web is wound onto the new, still empty reel. This so-called "reel change" takes place, as a general rule, at a fill operating speed of the paper machine. After reaching a transfer position, the winding of the winding roll is finished (completed) while the reel, together with the winding being produced on it, is moved along the second guide track. When the finished winding position is reached, the winding roll is finished. From a removal position, the winding roll is removed from the relevant winding machine, using, for example, a crane or other type of winding roll removing device.

In one preferred practical embodiment, the reel is cyclically inclined and the carrying drum is guided in a corresponding tracking motion, both during the transportation of the reel from the winding-start position to the transfer position, and during its transportation from the transfer position to the finished winding position.

The increase in the winding roll diameter can be compensated for, at least, in part, by a corresponding movement of the reel (or the winding roll being produced).

It is beneficial if an increase in the winding roll diameter during the transportation of the reel from the winding-start position to the transfer position is compensated for, at least in part, by a corresponding movement of the carrying drum, and during the transportation of the winding roll (that is being produced) from the transfer position to the finished winding position, is compensated for at, least in part, by a corresponding movement of the reel or the winding roll being produced.

The nip can be kept in a predetermined position during a transportation of the winding roll (that is being produced) along the second guide track. In practice, a limited movement of the nip will not adversely affect the performance of the instant invention during the transportation of the winding roll (that is being produced) along the second guide track.

In a preferred embodiment of the invention, the reel is cyclically inclined and the carrying drum is guided in a corresponding tracking motion, both during the transportation of the reel from the winding-start position to the transfer position, and during its transportation from the transfer position to the finished winding position. If separate drive devices are provided for the transportation along the fit guide track and for the transportation along the second guide track, then, upon reaching the transfer position, the relevant control of the side trraverse motion is suitably switched from one drive device to another drive device.

The second guide track, along which the winding roll (being produced) can be moved between the transfer position and the finished winding position, includes a linear, substantially horizontal course. While the winding roll (being produced) is transported along the second guide track, the winding roll is cyclically inclined in a suitable fashion in the plane of the second guide track. The carrying drum is kept in contact with the winding roll in order to maintain the nip, and in particular, to also maintain the respectively desired line force. As a result, the carrying drum executes a corresponding movement.

The first guide track can have a curved course. It is also possible that the first guide track extends linearly, and in so doing, extends at an incline to the horizontal.

If the material web is guided around a web guide roll before the carrying drum in the web travel direction, the web guide roll may also cyclically inclined. As a result, the cyclical inclination of the web guide roll occurs so that longitudinal stresses that are essentially equal are produced in both edge regions of the supplied material web.

Suitably, the web guide roll is cyclically inclined in a vertical plane.

Whereas the preferred embodiment discloses that the reel is cyclically inclined and a movable carrying drum is guided in a tracking motion in order to maintain the nip, another embodiment is disclosed in which the nip is maintained by having the carrying drum cyclically inclined and the movable reel guided in a tracking motion.

Further, in order to avoid the problems of the prior art, discussed above, the current invention provides that the winding of the material web, which is produced from a fibrous suspension and then dried, occurs after an on-line calendering of the material web (which follows the drying operation). After the on-line calendering of the material web take place, an axial changing of the material web in the winding roll is achieved. The winding process according to the invention can consequently be used in a paper machine in which a satination is provided.

According to the instant invention, the reel and/or the carrying drum is cyclically inclined in relation to the travel direction of the supplied material web by at least one associated drive device, in order to achieve an "axial changing" (e.g., a side traverse motion and a corresponding cyclical side offeset) of the material web in the winding roll being produced.

According to an object of the invention, a method is disclosed for winding a material web onto a reel. The method comprises guiding the material web around a carrying drum, in which a nip is formed between the carrying drum and the reel. The carrying drum and a winding roll are kept in contact with each other during the winding process. The reel and/or the carrying drum is cyclically inclined with respect to a travel direction of the material web to effect the "axial change" of the material web on the winding roll.

According to a feature of the invention, the reel is cyclically inclined, and the movable carrying drum is guided in a tracking motion to maintain the nip. In this regard, a line force in the nip is adjusted, to, for example, a constant predetermined value, in accordance with a moving of the carrying drum.

According to another feature of the invention, the reel is movable along a guide track. The reel and the winding roll may be transported along a first guide track from a winding-start position to a transfer position, and thereafter transported along a second guide track from the transfer position to a finished winding position. Further, the reel may be cyclically inclined when being transported from the winding-start position to the transfer position, and from the transfer position to the finished winding position. In this case, the carrying drum is guided in a corresponding tracking motion. The guide track may have a linear, substantially horizontal course. Alternatively, the guide track may have a curved course, with, or without with a linear course that is inclined with respect to a horizontal plane A still further feature of the invention is that an increase in a winding diameter of the winding roll may be compensated for by moving either the reel or the winding roil. In this regard, the increase in the winding diameter during a transport of the reel from a winding-start position to a transfer position may be compensated for by a movement of the carrying drum.

In a preferred embodiment, the material web may be guided around a web guide roll arranged before the carrying drum in a web travel direction. In this case, the web guide roll may be cyclically inclined, in, for example, a vertical plane. The cyclical inclination of the web guide roll occurs so that substantially equal longitudinal stresses are produced in two edge regions of the material web.

According to another advantage of the current invention, the carrying drum is cyclically inclined, and the reel is guided in a tracking motion in order to maintain the nip.

A still further advantage of the invention is that a winding roll is positioned after an on-line calendering device. The material web is thus wound onto the winding roll after an on-line calendering of the material web by the on-line calendering device. In this regard, the material web is axially changed after the material web leaves the on-line calendering device.

According to another object of the invention, an apparatus is disclosed for winding material web onto a reel to produce a winding roll. The apparatus includes a carrying drum, and an inclining device. The material web is guided around the carrying drum, such that a nip is formed between the carrying drum and the reel. The carrying drum and the winding roll are kept in contact with each other during a winding operation. The inclining device cyclically inclines the reel and/or the carrying drum with respect to a travel direction of the material web, in order to achieve an axial changing of the material web on the winding roll.

According to a feature of the invention, a drive device cyclically inclines the reel, while a moving device moves and guides the carrying drum in order to maintain the nip. The moving device adjusts a line force in the nip to maintain it at, for example, a constant predetermined value.

Alternatively, the carrying drum is cyclically inclined by the inclining device, with the reel being guided in a tracking motion to maintain the nip.

According to another feature, the winding apparatus includes a first guide track that guides a movement of the reel, and a second guide track. The reel and the winding roll are transported along the first guide track from a winding-start position to a transfer position, and transported along the second guide track from the transfer position to a finished winding position. The first guide track may include a primary storage to hold a next reel to be used, while the second guide track includes a secondary storage for holding a reel upon which the material web is wound. In this arrangement, according to the invention, a first drive device transports the reel along the first guide track, and a second drive device transports the reel along the second guide track.

An advantage of the invention is that the first drive device cyclically inclines the reel while the reel is transported along the first guide track, and the second drive device cyclically inclining the reel while the reel is transported along the second guide track. In this arrangement, the carrying drum is guided in a corresponding tracking motion of the inclining device.

Another advantage of the invention is the provision of a drive device that compensates for an increase in a diameter of the winding roll.

According to another advantage, the winding machine includes a first guide track, a first drive device, a second guide track, and a second drive device. The first drive device compensates for an increase in a diameter of the winding roll during a transport of the reel along the first guide track. The second drive device compensates for the increase in the diameter of the winding roll during a transport of the winding roll along the second guide track. The first guide track includes a curved course. In addition, the first guide track may include a linear course that is inclined with respect to a horizontal plane.

A still further advantage of the invention is that a web guide roll is provided. The material web is guided around the web guide roll, which is positioned before the carrying drum, in a web travel direction. The web guide roll is cyclically inclined by a drive device. The web guide roll may be cyclically inclined by the drive device in such a manner that substantially equal longitudinal stresses are produced along two edge regions of the material web. Alternatively, the web guide roll may be cyclically inclined in a vertical plane.

In a preferred embodiment, the winding apparatus of the current invention, may include first and second transport devices, first and second guide carriages, first and second position measurement devices, and first and second position regulators. The first and second transport devices include respective first and second drives, and first and second control devices. The reel is supported in a rotary fashion in the first and second transport devices. The carrying drum is supported in a rotary fashion by the first and second guide carriages. Each position measurement device generates a respective actual position value, which represents a current position of the carrying drum. Each actual position value signal is provided to the respective position regulator. Each position regulator compares the respective actual position value to a reference position value, and outputs a respective comparison result signal to their respective control device. A common reference position value is provided to each position regulator. Alternatively, the reference value generator supplies one position regulator with a constant reference value, while supplying a remaining reference value generator with a cyclically changing reference value. Still further, the reference value generator may supply a reference value to each position regulator that cyclically changes in opposition.

It is noted that an on-line calender may be associated with the winding apparatus. Further, a plurality of web guide rolls are provided that guide the material web to the on-line calendering.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings, by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of an example and for purposes of illustrative discussion of the present invention only and are presented in the course of providing what is believed to be the most useful and readily understood description of the principles and conceptual aspects of the present invention. In this regard, no attempt is made to show structural details of the present invention in more detail than is necessary for the fundamental understanding of the instant invention, the description taken with the drawings making apparent to those skilled in the art how the several forms of the present invention may be embodied in practice.

Figure 1:
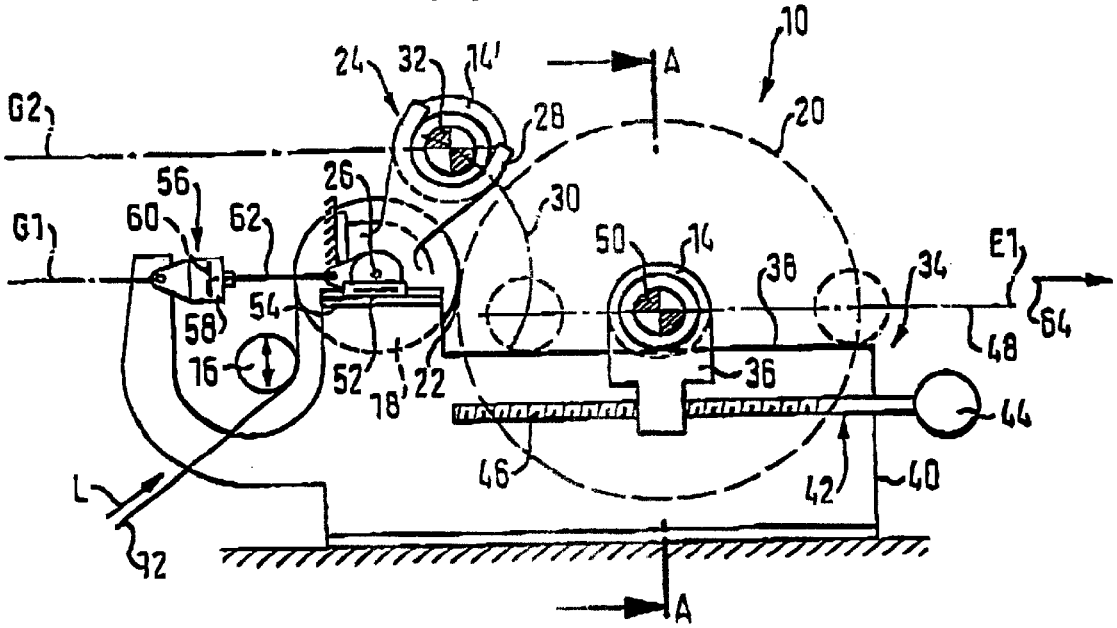
FIG. 1 illustrates a schematic side view of an embodiment of a winding machine that winds a material web onto a reel.

FIG. 1 illustrates a schematic side view of an exemplary embodiment of a winding machine 10 that winds a material web 12 onto a reel 14. In the disclosed embodiment, the material web 12 comprises, for example, a paper or cardboard web. However, it is understood that different type material webs 12 may be wound onto reel 14 without departing from the spirit and/or scope of the current invention.

The winding machine 10 is shown in FIG. 1 as being positioned at the end of a paper machine. However, it is understood that the winding machine 10 can be positioned at other locations.

As illustrated in FIG. 1, the material web 12 is guided around a web guide roll 16, a carrying drum 18, and onto the reel 14 on which the winding roll 20 is being produced (formed). FIG. 1 illustrates that a nip 22 is formed between the carrying drum 18 and the winding roll (that is being produced) 20. The nip 22 is maintained during the winding operation by keeping the carrying drum 18 and the winding roll 20 in contact with each other (to be discussed in detail below).

A next, still empty reel 14' is stored in a primary storage 24. In the disclosed embodiment, the primary storage 24 includes two levers 28 that are pivotable about an axis 26, only one of which is shown in FIG. 1. The levers 28 move the reel 14' along a first guide track 30, which in the current exemplary embodiment, comprises a circular path. A center point of the circular path is disposed on the axis 26.

The reel 14' is acted upon by a primary drive 32, which sets the reel 14' into rotation in the primary storage 24. The primary drive 32 can be moved along the first guide track 30.

The winding mache 10 also includes a secondary storage 34 which can, for example, have a transport device 36 that moves on a linear guide (not shown). The tansport device 36 is used to hold and guide reel 14. The winding machine 10 may additionally include rails 38 (only one of which is shown in FIG. 1) that are located on each side of the guide reel 14.

Rails 38 are disposed parallel to the horizontal and are fastened to a machine frame 40. Reel 14 is provided with bearing pins (not shown) that are placed onto the rails 38. As a result, the rails 38 carry the weight of reel 14 and the winding roll (being produced) 20.

A drive device 42 moves (drives) the winding roll 20. In the disclosed embodiment, the drive device 42 comprises two threaded spindles 46, in which one spindle is secured to an associated end of the reel 14 (see FIGS. 5 and 6). Each spindle is driven by an associated electric motor 44.

In the exemplary embodiment, the winding roll 20, together with the associated reel 14, is moved by the transport device 36 along a second guide track 48. The second guide track 48 extends substantially horizontally and is disposed in an imaginary first plane El that is substantially perpendicular to the horizontal plane.

A secondary drive 50 sets reel 14 into rotation in the secondary storage 34. In the disclosed embodiment the secondary drive 50 comprises a center drive that moves the reel 14 along second guide track 48. In the disclosed embodiment, the secondary drive 50 is disposed on the side of the winding machine 10, opposite from the primary drive 32. However, it is understood that variations/modifications to this drive system arrangement may be made without departing from the spirit and/or scope of the invention.

The carrying drum 18 is driven by a center drive. In the disclosed invention, the carrying drum 18 comprises a movable press drum, in which the carrying drum 18 is held by a guide carriage 52 that is movable on a guide 54 disposed substantially parallel to the rails 38 of the secondary storage 34. The center point of the carrying drum 18 is disposed on an imaginary first straight line G1, and extends substantially parallel to the second guide track 48. In the current invention, a vertical distance between the carrying drum 18 and the rails 38 remains substantially constant.

The carrying drum 18 may be set to different inclined positions. In this connection, the carrying drum 18 is associated with a particular press device 56 that is supported on the machine frame 40 to enable the carrying drum 18 to be set at various inclined positions.

Figure 5:
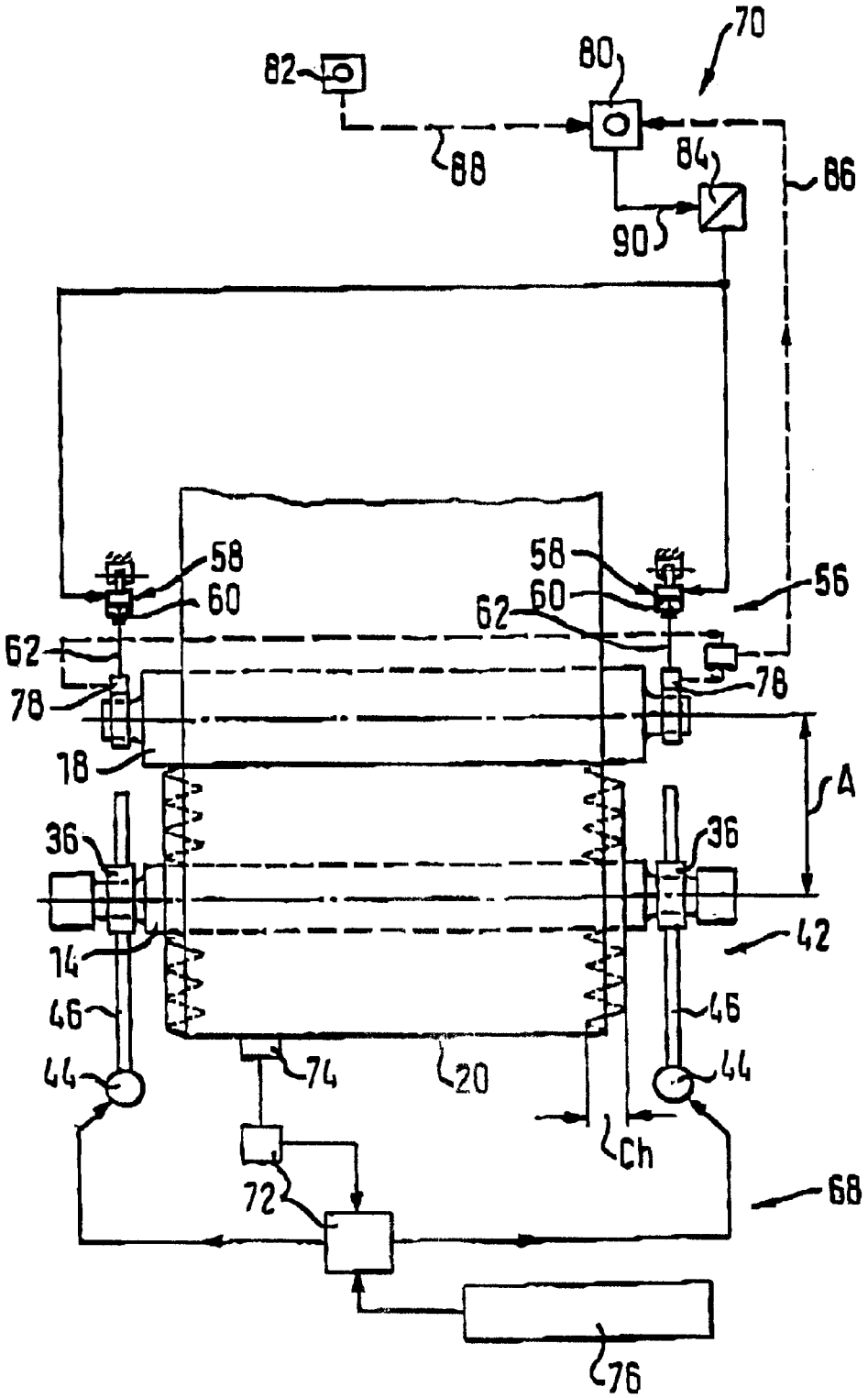
FIG. 5 shows a partial depiction, in accordance with FIG. 2, of the winding machine, with drive devices associated with a carrying drum and the reel, and control devices associated with the drive devices.

Referring to FIG. 5, the press device 56 includes at least two cylinder/piston units 58 that engage the two ends of the carrying drum 18. Each piston unit 60 is connected to an associated piston rod 62 that acts on the relevant drum end. When each piston rod 62 is in an extended position, the guide carriage 52 and carrying drum 18 is moved toward the winding roll 20, in the direction of arrow 64 (see FIG. 1). On the other hand, when each piston rod 62 is in a retracting position, the carrying drum 18 is moved in the opposite direction (i.e., toward the left in FIG. 1). An inclined position of the carrying drum 18 is obtained by differently actuating the two cylinder/piston units 58.

In the winding phase shown in FIG. 1, the carrying drum 18 forms the nip 22 with the winding roll 20 that is guided by the transport device 36.

The material web 12 is guided along web travel direction L by the web guide roll 16, and is vertically deflected upward by this roll. The material web 12 in the current instance is guided around the carrying drum 18 with a winding angle of approximately 180°. However, other angles may be used without departing form the spirit and/or scope of the invention.

The line force in the nip 22 is adjusted by the press device 56 associated with the carrying drum 18. As can be seen in FIG. 5, the press device 56 of the disclosed embodiment is part of a regulation circuit that automatically adjusts, and maintains, the line force to a desired value. Moving the carrying drum 18 with the press device 56 reliably compensates for (or prevents) fluctuations in the line force, so that the desired winding tightness can be continuously achieved. A corresponding movement of the winding roll 20, in the direction of arrow 64 (i.e., toward the right in FIG. 1) compensates for the increasing diameter of the winding roll 20, In the secondary storage 34, the reel 14 and, therefore the winding roll 20, is guided, so that different inclined positions of the winding roll 20 are petted. In this regard, the associated drive device 42 acts upon the reel 14, so that the winding roll 20 is cyclically inclined in relation to the travel direction L of the supplied material web 12, in order to achieve an axial changing of the material web 12 in the winding roll 20. The movable carrying drum 18 is guided on a corresponding tracking motion by the associated press device 56, so that the nip 22 is maintained and the line force in nip 22 is kept constant at a predetermined value.

As shown in FIG. 1, a next, still empty reel 14' is introduced into the primary storage 24 from above. Reel 14' is transported, by pivoting levers 28, along the fist guide track 50 from a winding-start position to a transfer position, as shown by dashed lines at the end of guide track 50 in FIG. 1. Starting from this transfer position, the winding roll (being produced) 20, together with the associated reel 14, are transported along the second guide track 48 to the finished winding position, which is shown in FIG. 1 by solid lines. Thereafter, the reel is transported to a removal position, indicated in FIG. 1 by dashed lines, from which the finished winding roll 20 is removed from the winding machine 10, by, for example, a crane or other removing device (not shown).

After the material web 20 is cut the relevant web end is wound onto the new, still empty reel 14'. During the reel change, the still empty reel 14' is rotated (spun) to bring the rotational speed of the reel 14' up to the traveling speed of the material web 12 before the material web 12 is transferred from the primary drive 32. The travel speed of the transport device 36, guiding the winding roll 20, can be varied (e.g., increased or decreased), for example, in order to transfer the continuous material web 12 onto the empty reel 14'. The carrying drum 18 remains in constant contact with the winding roll 20. Accordingly, the carrying drum 18 is guided in a corresponding tracking motion and the line force in the nip 22 is kept constant.

As shown in FIG. 1, before the levers 28 are pivoted in the downward direction, the empty reel 14' that has been inserted into the primary storage 24 assumes a position (indicated by horizontal straight line G2), in which the vertical distance between horizontal straight line G2 and horizontal straight line G1 (extending through the center point of the carrying drum 18) is less than a sum of a radii of the carrying drum 18 and the empty reel 14'. Therefore, the carrying drum 18 that has been moved toward the right (in FIG. 1) comes into contact with the still empty reel 14'. At the moment in which a nip is formed between the carrying drum 18 and the still empty reel 14', the reel change is triggered. During the reel change, the material web 12 is cut by a cutting device (not shown), the material web 20 is transported to the reel 14', and the material web 12 is wound onto reel 14'.

Prior to the cutting of the material web 12 and the transfer of the material web 12 to reel 14', the winding roll 20 is still in contact with the carrying drum 18. Thus, the winding roll 20 is only removed (lifted) from the carrying drum 18 after the winding-start operation of the reel 14' is performed. However, it is possible that the moment of the reel change, an intermediary space is formed between he winding roll and the carrying drum 18. After the material web 12 is wound onto reel 14', levers 28 of the primary storage 24 are pivoted in a clockwise direction around axis 26, causing reel 14' to be transported along the first guide track 30 to the transfer position, shown with dashed lines. Reel 14' is continuously driven by the primary drive 32. Consequently, the primary drive 32 is also moved along the fist guide track 30.

During the transportation of the reel 14' from the winding-start position (shown by solid lines in FIG. 1) to the transfer position (shown by dashed lines in FIG. 1), the carrying drum 18 is moved by the associated press device 56 along the straight line G1, wherein the line force in the nip is maintained at a desired value.

After a finished winding roll 20 has been moved to the removal position on the right (indicated by dashed lines in FIG. 1), the transport device 36 and the secondary drive 50 are moved to the take-over position, in order to remove the wound-on reel 14' from the primary storage 24. While the transport device 36 takes over the wound-on reel 14' from the levers 28 of the primary storage 24, the secondary drive 50 is coupled to the wound-on roll 14,' so that the primary drive 32 and secondary drive 50 are temporarily coupled to the reel 14'. The primary drive 32 is then uncoupled from reel 14' and moved in a counterclockwise direction along the first guide track 30, back to the winding-start position. During the transport of the reel 14' from the winding-start position to the transfer position along the first guide track 30, an increase in the winding diameter is compensated for by the press device 56 associated with the carrying drum 18, by a corresponding movement of the carrying drum 18. In contrast, while the winding roll 20 is being transported along the second guide track 48 from the transfer position to the finished winding position, the increase in the winding diameter is compensated for by the drive device 32 associated with the reel 14, by a corresponding movement of the reel 14 (or winding roll 20).

Figure 2:
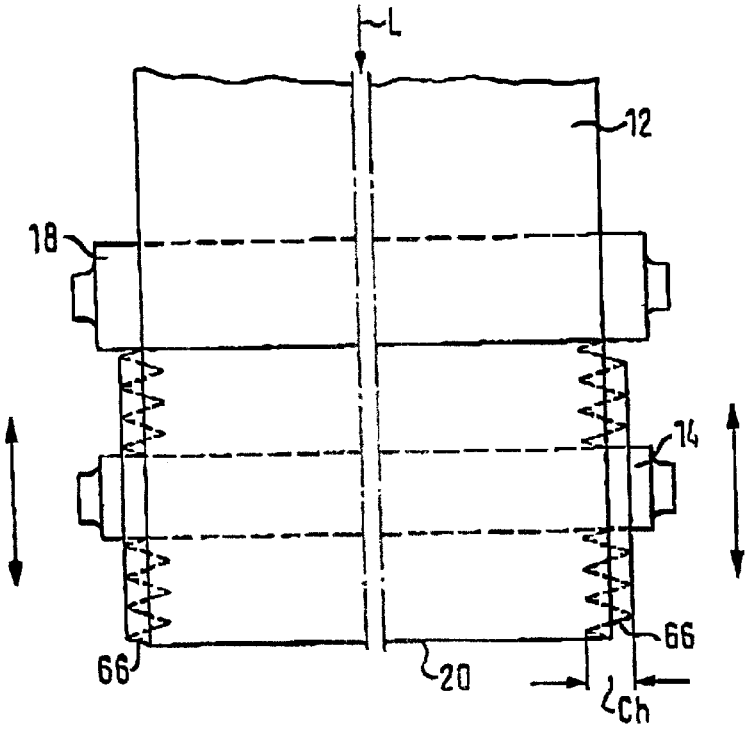
FIG. 2 illustrates a schematic top view of the winding machine of FIG. 1, wherein, for purposes of simplicity, a primary storage that contains the empty reel, as well as a web guide roll, are omitted.
Figure 3:
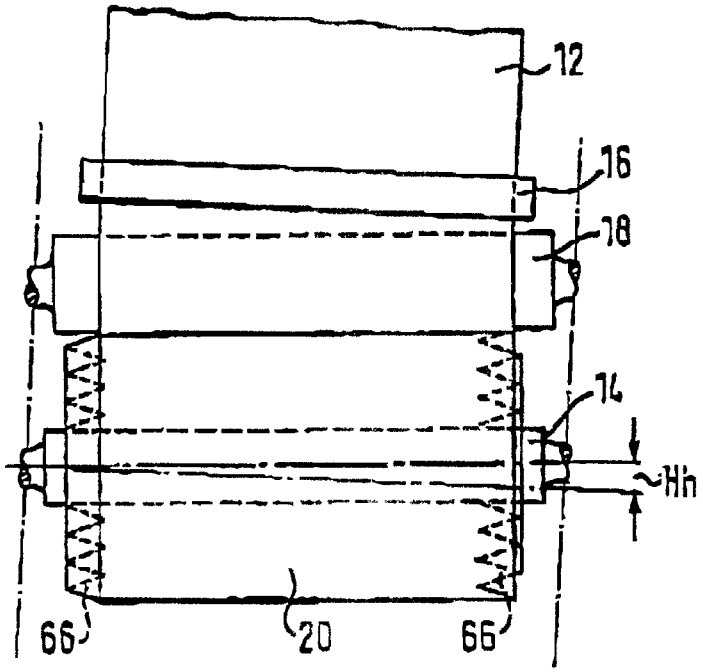
FIG. 3 illustrates a schematic top view of the winding machine of FIG. 1, with a cyclically inclined winding roll and a correspondingly cyclically inclined carrying drum, wherein the primary storage for containing the empty reel has been omitted.
Figure 4:
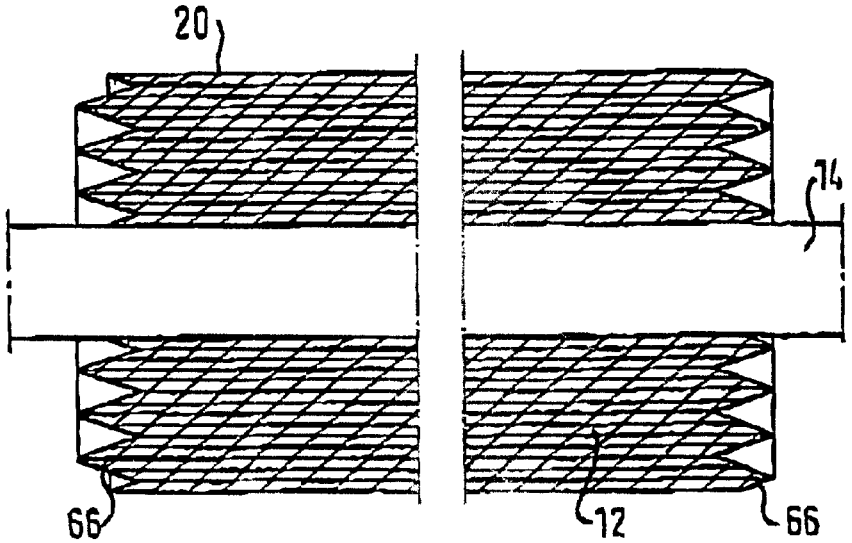
FIG. 4 shows a sectional view of a finished winding roll, cut along line A—A in FIG. 1.

Reel 14, and, therefore, winding roll 20, are cyclically inclined with respect to a travel direction L of the supplied material web 12, at least during a transport of the reel along the second guide track from the transfer position to the finished winding position, by the associated drive device 42 (see FIG. 5), so that a cyclical traverse motion and a corresponding cyclical side offset of the material web 12 is achieved in the winding roll 20, in a way indicated in FIGS. 2 to 4, by zigzag edges of the winding roll 20.

The traverse motion and the corresponding cyclical side offset of the material web according to FIG. 2 can be carried out, for example, so that the following relation is satisfied:

$$Ch = (Dk + Dt) \cdot \frac{Hh}{LE},$$

where:

Ch is equal to a traverse stroke;

Dk is equal to a diameter of the carrying drum 18;

Dt is equal to a diameter of the winding roll (being produced) 20;

Hh is equal to a maximal inclined position of the reel 14 (or the winding roll 20 (see FIG. 3); and LE is equal to the length of the reel 14 and the carrying drum 18, measured between engagement points of the drive device 42 and the press device 56, respectively, (see in particular FIGS. 2 and 5).

While the reel 14 and the carrying drum 18 extend at right angles lateral to the web travel direction L, according to FIG. 2, they assume an inclined position in FIG. 3.

Control devices 68 and 70, associated with the drive device 42 and the press device 56, are shown in schematic form in FIG. 5.

Control device 68, associated with reel 14, includes a control unit 72 that controls two electric motors 44 to drive the threaded spindles 46 in response to a change (e.g., increase) in the diameter of the winding roll 20. The diameter change in the winding roll 20 is measured by at least one measurement device 74. The drive device 42, associated with the reel 14, compensates for the change in the winding diameter of the winding roll 20. In addition, the control device 68 functions in accordance with a traverse motion program 76 that is input into the control unit 72 and provides for a control of the two electric motors 44, such that the reel 14 (or the winding roll 20) is cyclically inclined in the desired manner and the desired side offset of the material web 12 is achieved in the winding roll 20.

Control device 70, associated with the carrying drum 18, executes the desired line force regulation, by which the carrying drum 18 simultaneously tracks the winding roll 20, so that the carrying drum is also cyclically inclined in a corresponding manner. The control (or regulating) device 70 comprises a measurement device 78 for measuring the line force, a regulator 80, a reference value generator 82, and a control unit 84. Measurement device 78 is connected to the regulator 80 by a measurement line 86, in order to supply the measuring line with a corresponding actual value. Reference value generator 82 supplies the regulator 80 with a respective reference value via line 88. The regulator 80 is also connected, via line 90, to the control unit 84, in order to control the cylinder/piston units 58.

Figure 6:
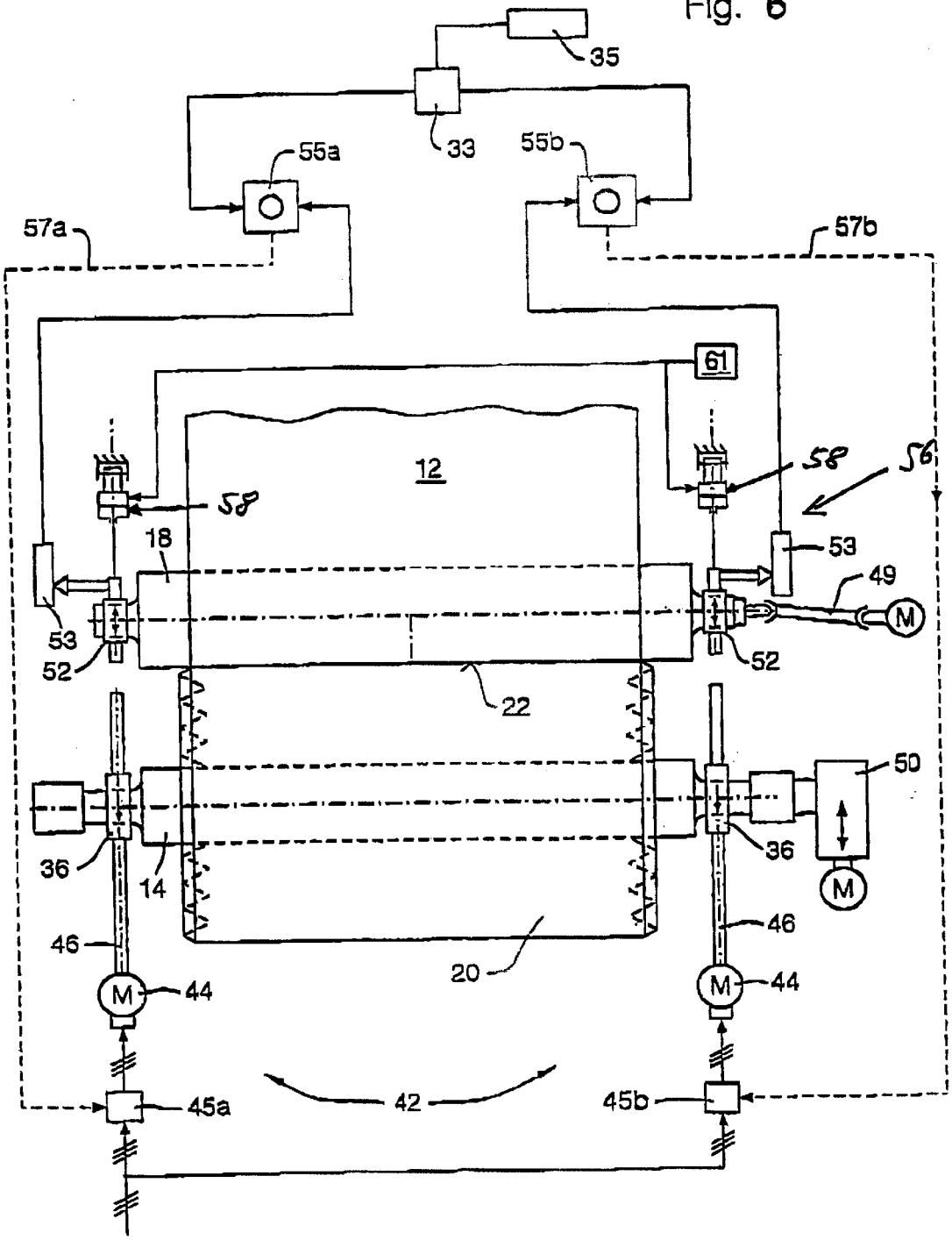
FIG. 6 shows a partial depiction, in accordance with FIG. 5, of the winding machine, with different control devices associated with the drive devices of the carrying drum and the reel.

FIG. 6 illustrates a partial depiction of the embodiment of the winding machine shown in FIG. 5. This embodiment differs from the previous embodiment in that a modification is made to the control devices associated with the drive devices of the carrying drum and the reel. This embodiment is directed to a winding machine that winds a material web 12, such as, for example, a paper or cardboard web, onto a reel 14, in which the material web 12 is guided around a carrying drum 18, with a nip 22 formed between the carrying drum 18 and the reel 14. The carrying drum 18 and the winding roll 20 are kept in contact with each other during the winding process in order to maintain nip 22. Reel 14 is cyclically inclined with respect to the travel direction of the supplied material web 12 by drive device 42, comprising drives 44 and 46, in order to achieve an axial changing of the material web 12 in the winding roll 20. The carrying drum 18 is movable by at least one associated press device, and can also be guided in a tracking motion in order to maintain nip 22. The line force in nip 22 is adjustable by at least one press device associated with the movable carrying drum 18. The increase in the winding diameter is compensated for, at least in part, by the drive device 42 associated with the reel 14, by a corresponding movement of the reel 14 (or the winding roll 20).

Reel 14 is supported in a rotary fashion in two transport devices 36. Each transport device 36 is provided with a drive 44 and 46, that is associated with the drive device 42, and a control device 45*a* or (45*b*) associated with this drive.

The carrying drum 18 is supported in a rotary fashion by two movable guide carriages 52. Each guide carriage 52 is associated with a position measurement device 53 that generates an actual position value that is a function of the current position of the carrying drum 18. The actual position value is supplied to a position regulator 55*a* (or 55*b*).

The position regulators 55*a* and 55*b* compare the actual position value with a reference position value. Each position regulator 55*a* and 55*b* supplies the respective control device 45*a* and 45*b* with an actuating variable signal that corresponds to the deviation of the actual position value from the reference position value.

The position regulators 55*a* and 55*b* are connected to a common reference value generator 33. In the current embodiment, the reference value generator 33 can supply, for example, the first position regulator 55*a* with a constant reference value while supplying the second position regulator 55*b* with a cyclically changing reference value. Alternatively, both position regulators 55*a* and 55*b* can be supplied with an identical signal.

It is noted that this embodiment may be further modified to, for example, have the reference value generator 33 supply the two position regulators 55*a* and 55*b* with reference values that cyclically change in opposition to one another.

As shown in FIG. 6, the reference value generator 33 is controlled by a change programmer 35. The change programmer 35 supplies the position regulator 55*a* and 55*b* with reference values that are cyclically variable in a corresponding manner. Each position regulator is connected to a respective control device 45*a* (or 45*b*), by a signal line 57*a* (or 57*b*). The line force in the nip 22 is adjusted by the press device associated with the carrying drum 18. The press device is part of a regulation circuit that automatically adjusts the line force to a desired value, and keeps the line force at the desired value, The pressure in the cylinder/piston units 58 is adjusted by a control unit 61 as a function of the longitudinal tension of the incoming material web 12, and/or the changing diameter of the winding roll, and/or other parameters, As shown in FIGS. 1 and 5, secondary drive 50 acts upon reel 14, The secondary drive 50 comprises a center drive, and can be moved along the second guide track 48 (also see FIG. 1). However, it is understood that other types of drives could be employed without departing from the spirit and/or scope of the instant invention.

The carrying drum 18 is, for example, driven by a universal shaft 49. However, it is understood that other types of drives can be employed without departing from the spirit and/or scope of the instant invention.

As a result, reel 14 is controlled by the associated drive device 42, so that the winding roll 20 is cyclically inclined in relation to the travel direction of the supplied material web 12, in order to achieve an axial changing of the material web 12 in the winding roll 20. This is illustrated in FIG. 6 by the zigzag edges of the winding roll 20. The movable carrying drum 18 is guided in a corresponding tracking motion by the associated press device 56, which includes the cylinder/piston units 58, so that the nip 22 is maintained. Consequently, the line force in the nip 22 is kept constant at a predetermined value.

The remaining aspects of the embodiment illustrated in FIG. 6 are the same as the embodiment shown in FIGS. 1 to 5.

Figure 7:
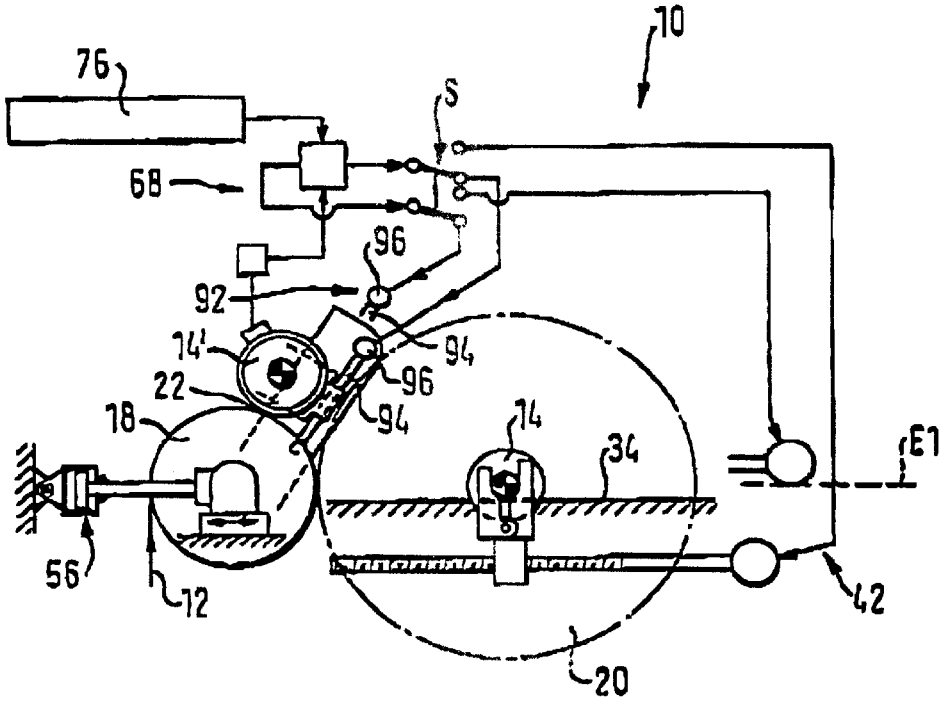
FIG. 7 illustrates a schematic side view of another embodiment of a winding machine that winds a material web onto a reel, with an associated drive control.

Another embodiment of the current invention is described with respect to FIG. 7. Winding machine 10, shown, in FIG. 7, differs from the previously described embodiments in that the wound-on reel 14' is cyclically inclined during a transport along the first guide track 30 (e.g., during a transport from the winding-start position to the transfer position by an associated drive device 92). Drive device 92 comprises at least two electric motors 92, each motor being associated with a respective threaded spindle 94. The line force in the nip 22 is regulated by the press device 56 that is associated with the carrying drum 18, so that the carrying drum 18 tracks the cyclically inclined reel 14'. The change (e.g., increase) in the winding diameter of the winding roll 20 is compensated for by the press device 56, associated with the carrying drum 18, by a corresponding movement of the carrying drum 18.

After the reel 14' is transferred to the secondary storage 34, the changing operation occurs again in the manner depicted in FIG. 5, wherein the change of the winding diameter is again carried out by the drive device 42 associated with the reel 14, by virtue of the fact that the drive device 42 increases distance A between the axes of the reel 14 and the carrying drum 18 in a correspondingly continuous manner, The embodiment of FIG. 7 includes a control device 68 that operates in accordance with a changing program 76. When the reel 14' is taken over by the secondary storage 34, the control device 68 is switched from controlling the drive device 92 to controlling the drive device 42 in response to an actuation of a switch S. When this occurs, the axes of the carrying drum 18 and the winding roll 20 are disposed in a same horizontal plane E1. This differs from the embodiment illustrated in FIG. 1, in which the carrying drum 18 is disposed with its axis somewhat higher than the axis of the winding roll 20 or the axis of the associated reel 14.

As with the embodiment shown in FIG. 1, it is noted that a web guide roll can optionally be provided, which can be cyclically inclined by an associated drive device in such a way that substantially equal turning stresses are produced in the two edge regions of the supplied material web 12.

Figure 8:
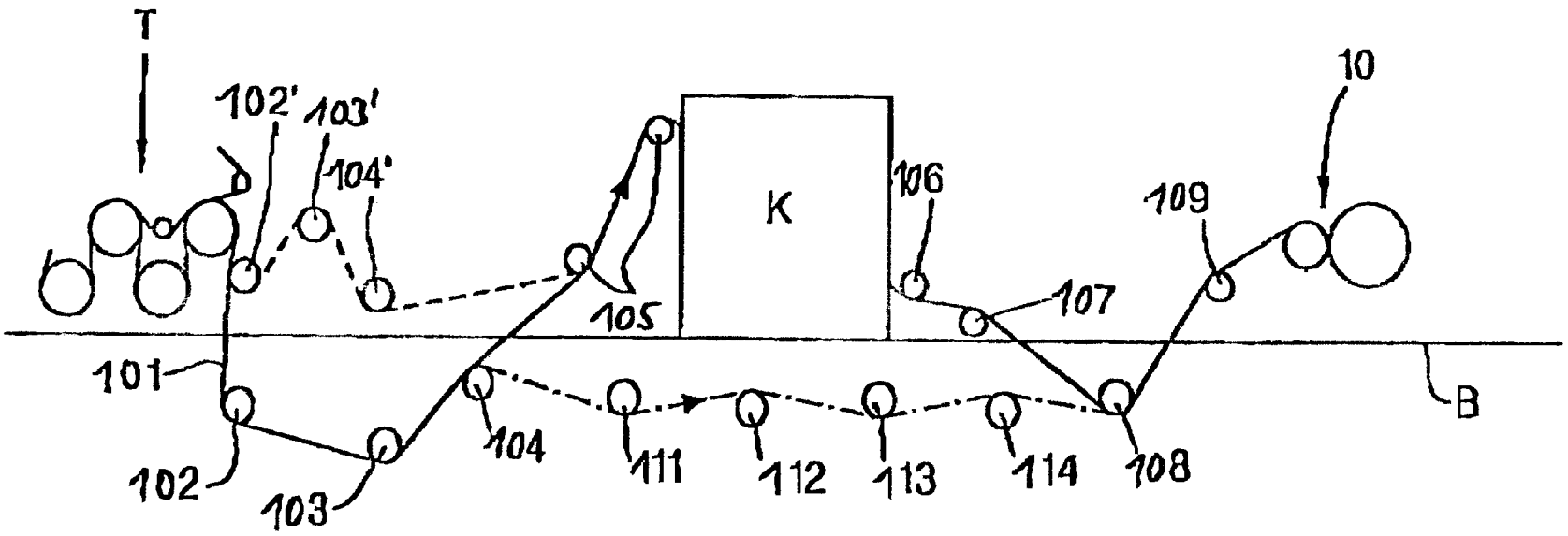
FIG. 8 illustrates a schematic side view of a dry end of a paper making machine, with a winding machine provided after an on-line calender.

FIG. 8 illustrates a schematic side view of a dry end of a paper making machine, in which a winding machine 10, according to the current invention, is provided following an on-line calender K.

As shown in FIG. 8, after material web 101 leaves a drying section T, the material web 101 is transported by web guide rolls 102, 103, 104 and 105 (or guide rolls 102', 103' and 104') to the on-line calender K. In the illustrated embodiment, the on-line calender K comprises a supercalender, or, alternatively, one or more intrinsically known calender stacks. The web material 101 is transported from the calender K via web guide rolls 106, 107, 108 and 109 to the winding machine 10, which is constructed in the manner described above with respect to the various embodiments of FIGS. 1 to 7.

It is noted that the present invention may be modified so that the winding of the material web 101, which is produced from a fibrous suspension and then normally dried, takes place after an on-line calendering of the material web 101 that follows the drying operation. After the on-line calendering of the material web 101, an axial changing of the material web 101 is achieved in the winding roll 20.

The guidance of the material web that characterizes the on-line operation is depicted in FIG. 8 with a solid line.

In the currently described embodiment, the web guide rolls 102, 103 and 104 are disposed underneath a paper machine floor B (e.g., it is located in, for example, a basement), while the web guide rolls 102', 103', 104', and 105 are disposed above the paper machine floor B.

The alternative material web guidance path to reach web guide roll 105 is depicted by dashed lines in FIG. 8.

In the embodiment of FIG. 8, web guide rolls 106, 107 and 109 are provided above the paper machine floor B, while web guide roll 108 is installed in the basement. However, it is understood that variations to this arrangement may be made without departing from the spirit and/or scope of the invention.

The respective positional conditions are decisive for the disposition of the web guide rolls to be selected.

If the dashed-line material web 101 (e.g., a coating machine which is not shown separately in FIG. 8, which would be disposed before the drying section T) or the solid-line web is not intended to be calendered, the material web 101 is diverted by web guide roll 104 to pass through guide rolls 111, 112, 113, 114, 108 and 109, thus by-passing the on-line calender K, before being transported to the winding machine 10.

The material web guidance path in the region of the web guide rolls 104 to 108 is depicted with dot-and-dash lines in FIG. 8.

It is noted that another possible web guidance path would be one that starts from the web guide roll 104' and proceeds to web guide roll 109 via guide rolls (not shown) positioned over the on-line calender K.

The material web 101 that is calendered in the on-line calender K, after being wound in the winding machine 10 according to the invention, may be further treated (for example, the material web may be subjected to a process to coat the material web) in order to obtain a desired web quality.

The foregoing examples have been provided merely for the purpose of explanation, and in no way is to be construed as limiting the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and/or spirit of the instant invention in its aspects. Although the present invention has been described herein with reference to particular means, materials and embodiments, the present invention extends to all functionally equivalent structures, methods and uses, such as are within the scope of the appended claims.

We claim:

1. A method for winding a material web onto a reel, comprising:

guiding the material web around a carrying drum, in which a nip is formed between the carrying drum and the reel, the carrying drum and a winding roll being kept in contact with each other during the winding process;

cyclically inclining at least one of the reel and the carrying drum in relation to a travel direction of the material web, while maintaining the nip along substantially the entire axial length of the carrying drum and reel, to effect an axial change of the material web on the winding roll;

cyclically inclining the reel; and guiding the carrying drum in a tracking motion to maintain the nip.

2. The method of claim 1, further comprising:

positioning a winding roll after an on-line calendering device, so that the material web is wound onto the winding roll after an on-line calendering of the material web by the on-line calendering device; and axially changing the material web after the material web leaves the on-lie calendering device.

3. The method of claim 1, further comprising adjusting a line force in the nip in accordance with a moving of the carrying drum.

4. The method of claim 3, further comprising maintaining the line force at predetermined values corresponding to a diameter of the winding roll.

5. A method for winding a material web onto a reel, comprising:

guiding the material web around a carrying drum, in which a nip is formed between the carrying drum and the reel, the carrying drum and a winding roll being kept in contact with each other during the winding process;

cyclically inclining at least one of the reel and the carrying drum in relation to a travel direction of the material web, while maintaining the nip along substantially the entire axial length of the carrying drum and reel, to effect an axial change of the material web on the winding roll;

moving the reel along a guide track;

transporting the reel and the winding roll along a first guide track from a winding-start position to a transfer position;

transporting the reel and the winding roll along a second guide track from the transfer position to a finished winding position;

cyclically inclining the reel during the transporting of the reel from the winding-start position to the transfer position;

cyclically inclining the reel during the transporting of the reel from the transfer position to the finished winding position; and guiding the carrying drum in a corresponding tracking motion.

6. A method for winding a material web onto a reel, comprising:

guiding the material web around a carrying drum, in which a nip is formed between the carrying drum and the reel, the carrying drum and a winding roll being kept in contact with each other during the winding process;

cyclically inclining at least one of the reel and the carrying drum in relation to a travel direction of the material web, while maintaining the nip along substantially the entire axial length of the carrying drum and reel, to effect an axial change of the material web on the winding roll;

cyclically inclining the carrying drum; and guiding the reel in a tracking motion in order to maintain the nip.

7. The method of claim 6, further comprising:

positioning a winding roll after an on-line calendering device, so that the material web is wound onto the winding roll after an on-line calendering of the material web by the on-line calendering device; and axially changing the material web after the material web leaves the on-line calendering device.

8. A winding apparatus that winds a material web onto a reel to produce a winding roll, comprising:

a carrying drum, the material web being guided around said carrying drum, a nip being formed between said carrying drum and the reel, said carrying drum and the winding roll being kept in contact with each other during a winding operation;

an inclining device that cyclically inclines at least one of the reel and said carrying drum with respect to a travel direction of the material web, while maintaining the nip along substantially the entire axial length of the carrying drum and reel, in order to achieve an axial changing of the material web on the winding roll;

a drive device that cyclically inclines the reel; and a moving device that moves and guides the carrying drum in order to maintain the nip.

9. The apparatus of claim 8, wherein said moving device adjusts a line force in the nip.

10. The apparatus of claim 9, wherein said line force is kept constant at a predetermined value.

11. The apparatus of claim 8, wherein said winding machine apparatus includes an on-line calender.

12. The apparatus of claim 11, further comprising:

a plurality of web guide rolls that guide the material web to said on-line calendering.

13. A winding apparatus that winds a material web onto a reel to produce a winding roll, comprising:

a carrying drum, the material web being guided around said carrying drum, a nip being formed between said carrying drum and the reel, said carrying drum and the winding roll being kept in contact with each other during a winding operation;

an inclining device that cyclically inclines at least one of the reel and said carrying drum with respect to a travel direction of the material web, while maintaining the nip along substantially the entire axial length of the carrying drum and reel, in order to achieve an axial changing of the material web on the winding roll;

a first guide track that guides a movement of the reel;

a second guide track, the reel and the winding roll being transported along said first guide track from a winding-start position to a transfer position, the reel and the winding roll being transported along said second guide track from said transfer position to a finished winding position;

a first drive device that transports the reel along said first guide track; and a second drive device that transports the reel along said second guide track;

wherein said first drive device cyclically inclines said reel while the reel is transported along said first guide track, said second drive device cyclically inclining the reel while the reel is transported along said second guide track, the carrying drum being guided in a corresponding tracking motion of said inclining device.

14. A winding apparatus that winds a material web onto a reel to produce a winding roll, comprising:

a carrying drum, the material web being guided around said carrying drum, a nip being formed between said carrying drum and the reel, said carrying drum and the winding roll being kept in contact with each other during a winding operation;

an inclining device that cyclically inclines at least one of the reel and said carrying drum with respect to a travel direction of the material web, while maintaining the nip along substantially the entire axial length of the carrying drum and reel, in order to achieve an axial changing of the material web on the winding roll;

wherein the carrying drum is cyclically inclined by said inclining device, the reel being guided in a tracking motion to maintain the nip.

15. The apparatus of claim 14, wherein said winding machine apparatus includes an on-line calender.

16. The apparatus of claim 15, further comprising:

a plurality of web guide rolls that guide the material web to said on-line calendering.

* * * * *